United States Patent [19]

Unger et al.

[11] Patent Number: 4,885,810

[45] Date of Patent: Dec. 12, 1989

[54] ARTICULATED LITTER FOR HYDROTHERAPY

[76] Inventors: Gregory T. Unger; Daniel D. Unger, both of P.O. Box A, New Berlinville, Pa. 19545

[21] Appl. No.: 313,613

[22] Filed: Apr. 17, 1989

Related U.S. Application Data

[63] Continuation of Ser. No. 37,840, Apr. 13, 1987, abandoned.

[51] Int. Cl.[4] ..... E04H 3/18; A47K 3/12

[52] U.S. Cl. ..... 4/496; 4/562; 5/81 R

[58] Field of Search ..... 4/560–566, 4/496; 5/81 R, 81 B, 63, 90, 86

[56] References Cited

U.S. PATENT DOCUMENTS

| | | | |
|---|---|---|---|
| 2,680,855 | 6/1954 | Robinson | 4/562 |
| 3,640,520 | 2/1972 | Wieland | 5/63 X |
| 4,085,472 | 4/1978 | Dimatteo | 4/560 X |
| 4,183,106 | 1/1980 | Grimes | 4/563 X |
| 4,255,823 | 3/1987 | Boyer et al. | 4/562 X |
| 4,685,159 | 8/1987 | Oetiker | 5/90 X |
| 4,733,418 | 3/1988 | Luther | 4/563 X |

*Primary Examiner*—Charles E. Phillips

*Attorney, Agent, or Firm*—Leonard Michael Quittner

[57] ABSTRACT

An articulated liter is disclosed for assisting disabled patients in getting in and out of hydrotherapeutic pools. The litter moves progressively from a chair-like position for the patient to sit on, to a horizontal position in which the patient is supported in a supine position, to a position in which the litter is cantilevered over the pool and finally into a substantially vertical position in which the free end of the litter and the patient are submerged within the pool. The progressive movements of the litter are reversed to remove the patient from the pool.

4 Claims, 3 Drawing Sheets

FIG. 2
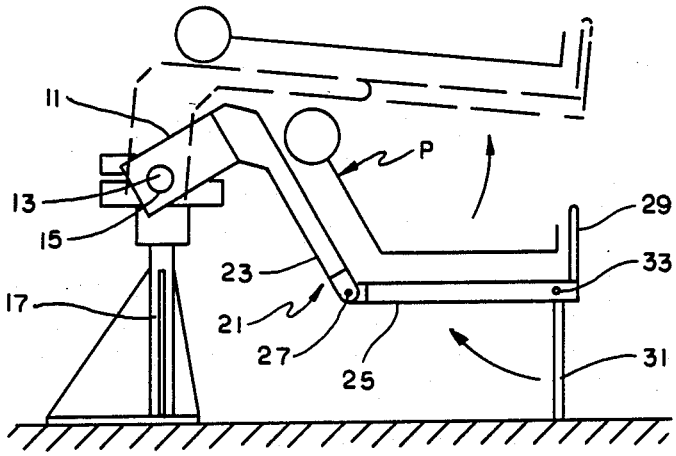
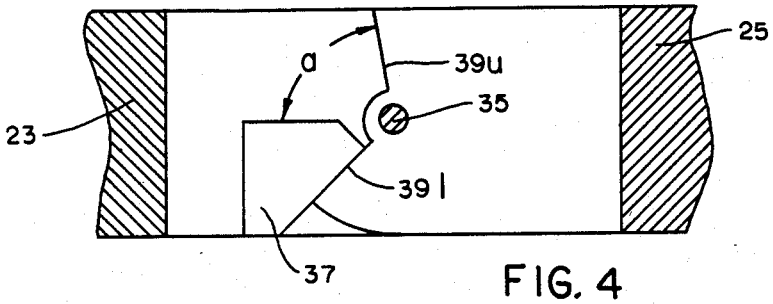
FIG. 4
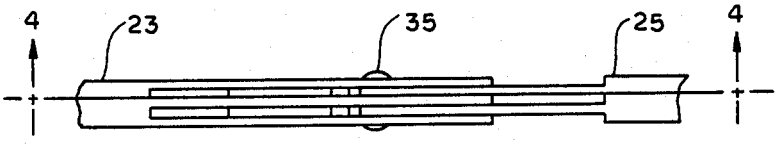
FIG. 3

FIG. 5
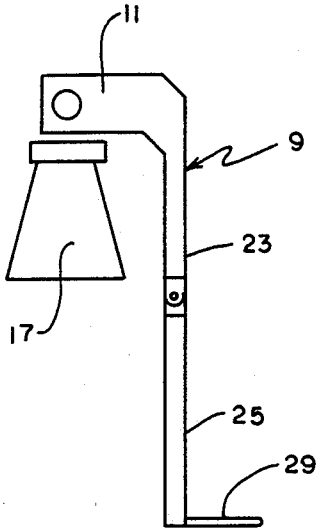
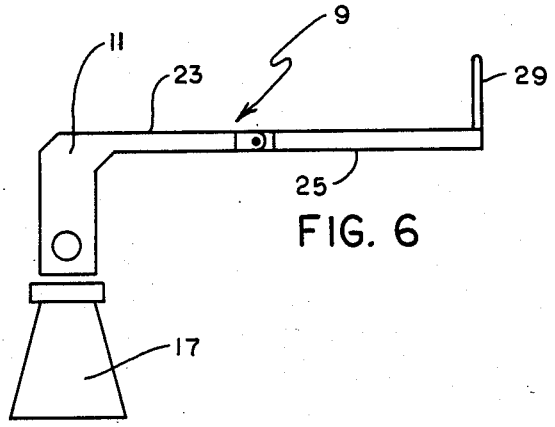
FIG. 6
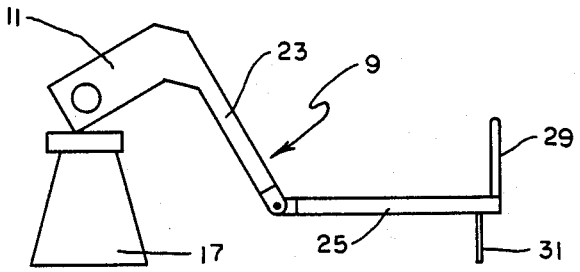
FIG. 7

ARTICULATED LITTER FOR HYDROTHERAPY

CROSS REFERENCES

This is a continuation of application Ser. No. 037,840 filed 4/13/87, now abandoned.

FEDERALLY-SPONSORED RIGHTS

The invention herein was made without any federal sponsorship or contribution.

BACKGROUND OF THE INVENTION

1. Field of the Invention

This invention relates to an articulated litter and, more particularly, to a device for assisting disabled patients in getting in and out of hydrotherapeutic pools.

2. Description of the Prior Art

Pools of warm and often circulating water are used in the treatment of persons such as those who may have been disabled in accidents, who suffer nervous disorders, who have circulatory problems, who have become disabled by strokes or who may have been fitted with a prosthesis. The buoyancy of the water in the pool gives an invalid increased facility to move his limbs and regain loss of coordination and develop muscle strength and tone. Also warm circulating waters will improve a patients circulation and salts dissolved in the water may have therapeutic value.

Some patients are unable to enter and leave these pools safely without assistance. It does not matter if the pools are sunken with their top flush with the floor or if they are partially or totally elevated above the floor level since, in any event, a patient must climb or descend a ladder to get in or out of the pool.

U.S. Pat. No. 4,551,108 illustrates a therapeutic pool of the type with which this invention is concerned and speaks to the care that must be taken with the patient to protect him from accidental drowning. The present invention, however, is not so much concerned with the patient's safety while in the pool as it is with helping a disabled patient get in and out of a pool with a minimum of movement and effort.

SUMMARY OF THE INVENTION

Accordingly, it is an object of this invention to provide methods and means to make it easy and safe for patients to enter and leave therapeutic pools.

Another object of this invention is to provide support for the entire body of a patient while he is being placed in or taken out of a therapeutic pool.

A further object of this invention is to provide an articulated mechanical device that safely and efficiently can be used to transport a patient into and out of a therapeutic pool without requiring exertion or muscular coordination on the part of the patient.

These and other objects of this invention will become apparent in connection with the following drawings.

BRIEF DESCRIPTION OF THE DRAWINGS

FIG. 2 shows the articulated litter of this invention in position to receive a patient and, in the phantom view, the articulated litter is in an elevation position from which the litter may be swung from poolside to a cantilevered position over the pool;

FIG. 3 is a plan view of an articulated joint useful in this invention;

FIG. 4 is a section taken along line 4—4 of FIG. 3;

FIGS. 5, 6 and 7 are schematic illustrations of the articulated litter of this invention in its three operational positions, i.e., for the patient to step into or out of the pool (FIG. 5); for swinging the litter back and forth between positions over the poolside and cantilevered over the pool (FIG. 6); and for the patient to mount or dismount the litter while at poolside (FIG. 7).

DETAILED DESCRIPTION OF THE DRAWINGS

Figure 1:
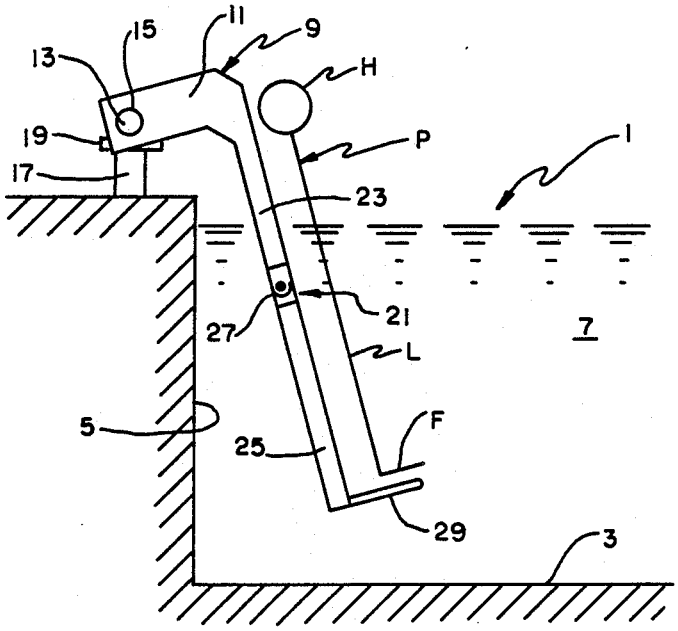
FIG. 1 is a schematic view illustrating the articulated litter of this invention supporting a person in position to enter or leave a therapeutic pool.

With particular reference to FIG. 1, a pool 1 having an impervious bottom 3 and an impervious side wall 5 is filled with water 7. The articulated device 9 of this invention is illustrated as being partially immersed in the therapeutic pool 1. The articulated device 9 is cantilevered at its one end from a rotatable head 11 which is mounted for rotation about a horizontal axis 13. A motor 15, which may be electrically, hydraulicly or hand driven, provides the force required to rotate the head 11 about its horizontal axis of rotation 13.

As shown in FIG. 1, a litter 21 depends from and is rigidly attached to the rotatable head 11. The litter as here shown has an inner arm 23 and an outer arm 25 and the arms are pivotally connected by an articulated joint 27. The outer arm carries at its outboard extremity a turned up portion which forms a platform 29 upon which a patient may place his feet for support.

For purposes of clarity, a person P is illustrated in stick form having a head H, legs L, and feet F, as supported on the litter 21. From the position shown, in FIG. 1, a person P can easily step off the platform 29 onto the bottom 3 of the pool 1 or, if already in the pool 1, may step up onto the platform 29 for removal from the pool.

FIG. 2 illustrates the device of this invention while it is out of the pool. The solid lines illustrate the litter 21 in position to receive or discharge a patient. Note that in this position the articulated litter 21 is bent at its joint 27 with the outer arm 25 of the litter parallel to the ground to provide a platform upon which a patient can sit for mounting or dismounting the litter. The outboard end of the outer arm 25 is supported in this position by means of a support leg 31 which is pivoted around a bearing 33 for rotation into and out of a storage position flush against outer arm 25.

It can be understood that when the rotatable head is turned counterclockwise (as shown by dotted lines in FIG. 2) the litter 9 can be elevated to a substantially horizontal position and the outer arm 25 will be pulled by gravity into planar alignment with the inner arm 23. From this position, the litter 21 can be slued about the vertical axis of the pedestal 17 until the litter 21 and the supine patient it carries are cantilevered out over the pool 1. The motor 15 is then activated to rotate the litter clockwise around the horizontal axis 13 and when the litter reaches a substantially up and down position, it is an easy task for the patient to step off platform 29 onto the bottom 3 of the pool, and vice versa.

The details of joint 27 are illustrated in FIGS. 3 and 4 where the inner arm 23 and the outer arm 25 are shown joined for rotation with respect to each other by a pivot pin 35. The inner arm 23 carries a stop block 37 which, acting in conjunction with the upper **39*u* and lower 39*l* angular faces fashioned on the end of outer arm 25, limit the rotation of the arms with respect to each other through an angle "a", here illustrated as being about 75 degrees. It can be understood that when the rotatable head 11 moves the litter into a substantially horizontal position, stop block 37 will seat against the outer angular face 39***l* of the outer arm 25. On the other hand, when the rotatable head 11 is moved into the loading position as illustrated in FIG. 2, the stop block 37 will seat against the upper angular face 39*u* of the outer arm 25 to maintain the outer arm 25, with the assistance of support leg 31, in a substantially horizontally position. In the device here described there is no need for the angular movement "a" between the inner 23 and outer arm 25 to exceed 90 degrees and it is preferred that the angular movement "a" be restricted to about 75 degrees.

In practice it can be understood that a patient may sit on the platform provided by outer arm 25 and then slide into a sitting position as shown in FIG. 2 with his feet resting against the platform 29. The motor 15 is actuated to turn the rotatable head 11 in a counterclockwise direction until the litter is horizontal and the patient is supported in a supine position. (See dotted lines in FIG. 2). Now the device is slued about the vertical axis of the pedestal 17 until the litter is cantilevered out over the pool. The motor 15 is powered to twist the rotatable head 11 in a clockwise direction and deposit the patient safely within the pool in a substantially up-and-down position. (See FIG. 1) The partially submerged patient may now step off the foot support 29 in an apparent weightless state and perform exercises in the pool without danger of falling or placing weight on a sensitive part of his body. To leave the pool, the above dismounting procedure is reversed, the litter 21 is rotated into a horizontal position, it is then slued from over the pool to poolside and finally rotated into the sitting position illustrated in FIG. 7.

It should be understood that the patient may wear a flotation device or be attached to safety lines as shown in U.S. Pat. No. 4,551,108 since the litter of this invention is designed not to interfere with the use of such safety devices.

What is claimed is:

1. An articulated litter adapted to aid a patient in entering or leaving a hydrotherapeutic pool comprising:

an upstanding pedestal mounted adjacent said pool and carrying a vertically disposed shaft mounted for rotation around its vertical axis;

a rotatable head positioned at the upper end of the vertical shaft mounted for rotation around a horizontal axis;

a litter having a top side and a bottom side, said top side being generally planar to support a patient and having a head portion and a foot portion with the foot portion including a platform extending generally normal to said top side, said rotatable head being attached to the litter at said underside opposite the head portion in a generally normal orientation, said rotatable head being of such length that with said pedestal mounted on the edge of said pool and said litter positioned in a generally vertical orientation with the patient standing on the platform, said litter and patient will be located in said pool, said patient maybe moved out of said pool and held in a horizontal position overlying said pool edge by rotation of said rotatable head and said shaft.

2. An articulated litter according to claim 1 wherein the litter is comprised of an inner and outer arm joined for rotation with respect to each other.

3. An articulated litter according to claim 2 wherein a stop is provided to limit the rotation of the inner and outer arms with respect to each other to less than about 90 degrees.

4. An articulated litter according to claim 3 in which a support leg is pivotally mounted at the outboard end of the outer arm to permit swinging the support leg from a storage position in the plane of the outer arm into a support position perpendicular to the plane of the outer arm.

* * * * *